US009857153B1

(12) United States Patent
Redline

(10) Patent No.: US 9,857,153 B1
(45) Date of Patent: Jan. 2, 2018

(54) BROADHEAD WITH DYNAMIC BLADES DEPLOYED ON IMPACT

(71) Applicant: Christopher Redline, Smithville, MO (US)

(72) Inventor: Christopher Redline, Smithville, MO (US)

( * ) Notice: Subject to any disclaimer, the term of this patent is extended or adjusted under 35 U.S.C. 154(b) by 0 days.

(21) Appl. No.: 15/489,985

(22) Filed: Apr. 18, 2017

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583, 584
See application file for complete search history.

(56) References Cited

U.S. PATENT DOCUMENTS 5,046,744 A * 9/1991 Eddy ..... F42B 6/08 473/583
5,078,407 A * 1/1992 Carlston ..... F42B 6/08 473/583
5,100,143 A * 3/1992 Puckett ..... F42B 6/08 473/583
5,178,398 A * 1/1993 Eddy ..... F42B 6/08 473/583
5,458,341 A * 10/1995 Forrest ..... F42B 6/08 473/583
5,803,844 A * 9/1998 Anderson ..... F42B 6/08 473/583
5,803,845 A * 9/1998 Anderson ..... F42B 6/08 473/583
6,015,357 A * 1/2000 Rizza ..... F42B 6/08 473/583
6,217,467 B1 * 4/2001 Maleski ..... F42B 6/08 473/583
7,377,869 B2 * 5/2008 Wohlfeil ..... F42B 6/08 473/583
8,128,521 B1 * 3/2012 Ulmer ..... F42B 6/08 473/583
8,272,979 B1 * 9/2012 Cooper ..... F42B 6/08 473/583
9,017,191 B2 * 4/2015 Treto ..... F42B 6/08 473/583
9,028,349 B2 * 5/2015 Budris ..... F42B 6/08 473/583
9,170,078 B2 * 10/2015 Pedersen ..... F42B 6/08
9,303,963 B1 * 4/2016 Ford ..... F42B 12/34
9,372,056 B2 * 6/2016 Sullivan ..... F42B 12/34

* cited by examiner

*Primary Examiner* — Alexander Niconovich
(74) *Attorney, Agent, or Firm* — Dale J. Ream

(57) ABSTRACT

A broadhead with dynamic blades that deploy upon impact with an animal includes a body defining an interior area. A pair of trigger blades is rotatably mounted inside the interior area and movable between an initially deployed configuration extending outwardly away from the side wall and a rotated configuration. A pair of dynamic blades is rotatably mounted inside the interior area and movable between a retracted configuration completely inside the interior area and an extended configuration extending outwardly from the body. A ring associated with the body is slidably movable between a flight configuration positioned proximate the front end of the body that prevents the dynamic blades from moving to the deployed configuration and an actuated configuration displaced from the front end that actuates the trigger blades to move the dynamic blades to the extended configuration.

18 Claims, 7 Drawing Sheets

BROADHEAD WITH DYNAMIC BLADES DEPLOYED ON IMPACT

BACKGROUND OF THE INVENTION

This invention relates generally to broadheads used in bow hunting and, more particularly, to a broadhead having dynamic blades that deploy upon impact with an animal such that a larger hole is created upon exiting from the animal after being shot.

A broadhead is a cutting point assembly often attached to the tip of an arrow to be shot from a crossbow or compound bow. The blades of a broadhead are intended to penetrate and even cut all the way through an animal when impacted, such as when hunting. Broadheads not only penetrate effectively but can produce major blood trails that make tracking the game easier for the hunter. Choosing an effective broadhead for use with an arrow is a difficult but very important decision by a hunter.

Various broadhead designs have been proposed in the prior art. For instance, broadheads with varying blade configurations are available for hunting various animals and birds. Although presumably effective for their intended purposes, existing devices and patent designs are still not optimal for thoroughly penetrating through an animal and maximizing the exit wound for optimal blood trail.

Therefore, it would be desirable to have a broadhead having dynamic blades that are not deployed outwardly until the broadhead has impacted its target (e.g. an animal). Further, it would be desirable to have a pair of trigger blades that are deployed outwardly during flight and which mechanically actuate a set of dynamic blades to deploy only upon impacting the targeted animal. In addition, it would be desirable to have a fixed pair of blades that may be rotated to avoid a barbed condition by manual effort of the hunter after the hunt is concluded.

SUMMARY OF THE INVENTION

A broadhead with dynamic blades that deploy upon impact with an animal according to the present invention includes a body having opposed front and rear ends and a side wall defining an interior area. A pair of trigger blades is rotatably mounted on a trigger mounting pin inside the interior area and movable between an initially deployed configuration in which distal ends of respective trigger blades extend outwardly away from the side wall and a rotated configuration. A pair of dynamic blades is rotatably mounted on a dynamic blade mounting pin inside the interior area and movable between a retracted configuration completely inside the interior area and an extended configuration extending outwardly from the body.

A ring associated with the body is slidably movable between a flight configuration positioned proximate the front end of the body that prevents the dynamic blades from moving to the deployed configuration and an actuated configuration displaced from the front end that bears against the distal ends of the pair of trigger blades and allows the dynamic blades to move to the deployed configuration. The trigger blades are operatively coupled to the dynamic blades so as to cause the dynamic blades to deploy when the ring actuates the trigger blades in the deployed configuration.

Therefore, a general object of this invention is to provide a broadhead for attachment to an arrow that has dynamic blades that are retracted during flight and deployed only after impact with a targeted animal.

Another object of this invention is to provide a broadhead, as aforesaid, in which initially deployed trigger blades mechanically cause deployment of the dynamic blades when the trigger blades impact the internal portions of an impacted animal.

Still another object of this invention is to provide a broadhead, as aforesaid, in which fixed blades that are unmovable during flight are held in place by a shim having bent tabs that may be selectively bent to allow rotation of the fixed blades to prevent a barbed condition.

Yet another object of this invention is to provide a broadhead, as aforesaid, in which a ring (such as an O-ring) is initially positioned to prevent deployment of the dynamic blades but which is rearwardly moved upon impact so as to allow deployment of the dynamic blades.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
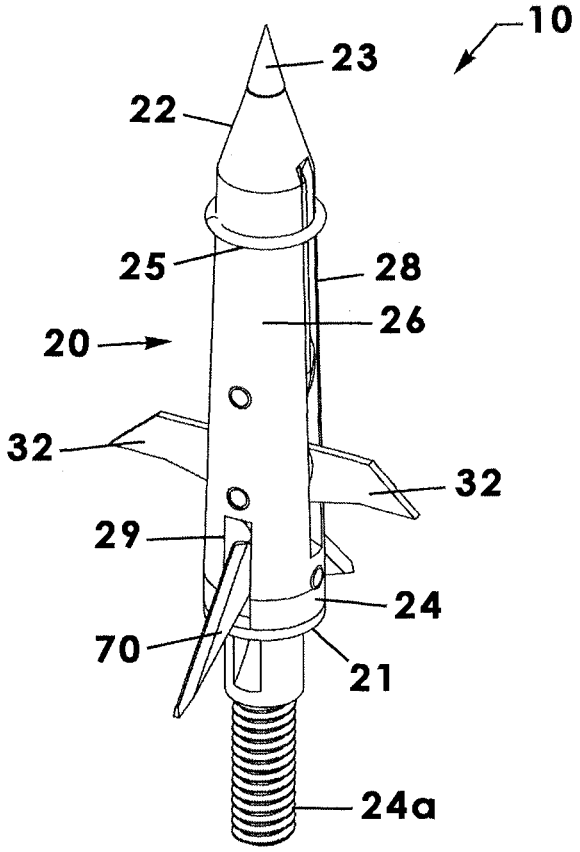
FIG. 1*a* is a perspective view of a broadhead for arrow according to a preferred embodiment of the present invention, illustrated with trigger blades at a deployed configuration.

A broadhead having dynamic blades deployed upon initial impact according to a preferred embodiment of the present invention will now be described in detail with reference to FIGS. 1*a* to 7*c* of the accompanying drawings. The broadhead 10 may include a pair of fixed blades 70, a pair of trigger blades 32, a pair of dynamic blades 52, and a ring 25 slidably coupled to a body 20 for actuating deployment of the dynamic blades 52 upon initial impact with an animal while hunting.

The broadhead 10 includes a body 20 having a front end 22, a rear end 24 opposite the front end 22, and a continuous side wall 26 extending between the front and rear ends. In other words, the broadhead 10 has a generally cylindrical configuration and the side wall 26 defines a hollow interior area that houses the internal components described below. Preferably, the front end 22 of the body 20 has a rounded or domed configuration extending upwardly and having a pointed or sharp tip 23 capable of piercing and penetrating the skin and body of an animal upon impact therewith while hunting. The rear end 24 of the body 20 includes a threaded member 24*a* having a cylindrical and longitudinal configuration extending away from the rear end 24, the threaded member 24*a* being capable of being received into a counterbore of an arrow shaft (not shown). In other words, the threaded member 24*a* enables the broadhead 10 to be coupled to the front of an arrow shaft in a traditional manner. A metal bearing washer 21 may be fitted and positioned adjacent the rear end 24 of the body 20, the washer 21 acting as a shield or reinforcement to prevent the trigger blades 70 from causing damage to the arrow (not shown) to which it is attached during impact with an animal or target.

The side wall 26 defines a pair of oppositely disposed upper blade slots 28 that extend substantially between the front end 22 and rear end 24 of the body 20, each upper blade slot 28 being in communication with the interior cavity defined by the body 20. Similarly, the side wall 26 may define a pair of lower blade slots 29 adjacent the rear end 24 of the body 20, each lower blade slot 29 being in communication with the interior area.

It is understood that the pairs of blades described below are reverse or mirror images of one another and extend in opposite directions as will be apparent from the drawings and the following description. Each single blade of a pair of blades, however, is independently operable.

Figure 4B:
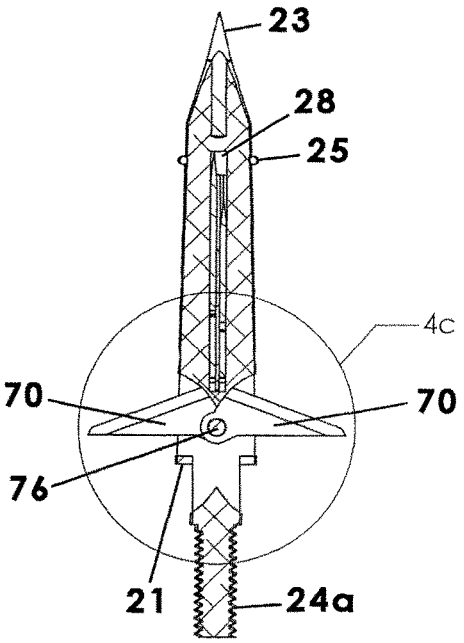
FIG. 4*b* is a sectional taken along line 4*b*-4*b* of FIG. 4*a* and illustrating the fixed blades in a rotated configuration.
Figure 4A:
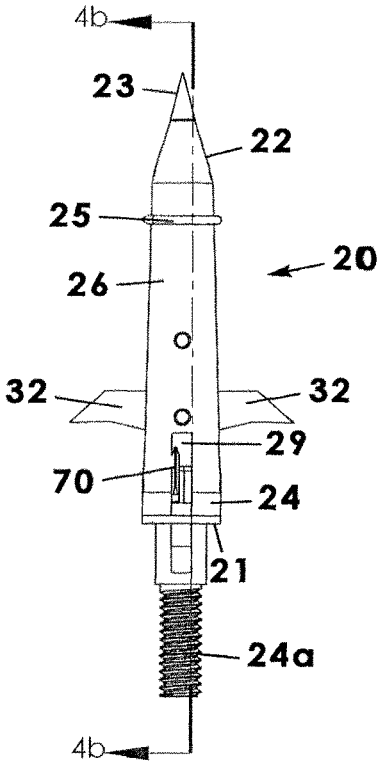
FIG. 4*a* is another side view of the broadhead as in FIG. 1*a;*
Figure 4C:
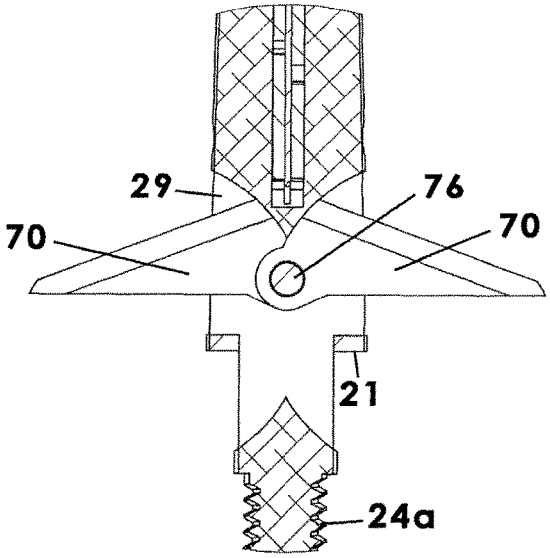
FIG. 4*c* is an isolated view on an enlarged scale taken from FIG. 4*b;*
Figure 5C:
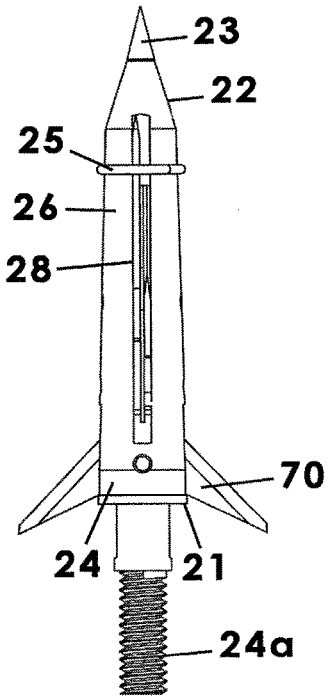
FIG. 5*c* is a side view of the broadhead as in FIG. 5*a* rotated 90 degrees.
Figure 5A:
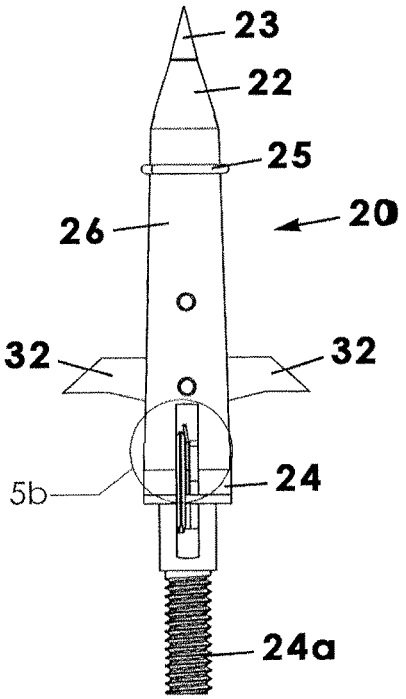
FIG. 5*a* is another side view of the broadhead as in FIG. 1*a;*
Figure 5B:
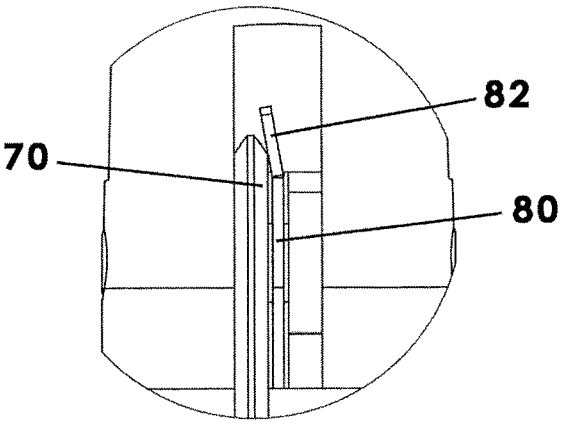
FIG. 5*b* is an isolated view on an enlarged scale taken from FIG. 5*a;*
Figure 7B:
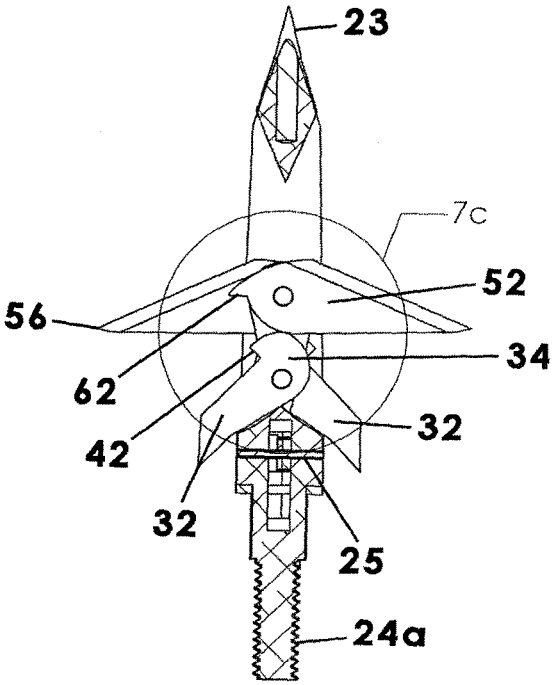
FIG. 7*b* is a sectional view taken along line 7*b*-7*b* of FIG. 7*a* illustrating the dynamic blades in an extended configuration and the trigger blades in a rotated configuration.
Figure 7A:
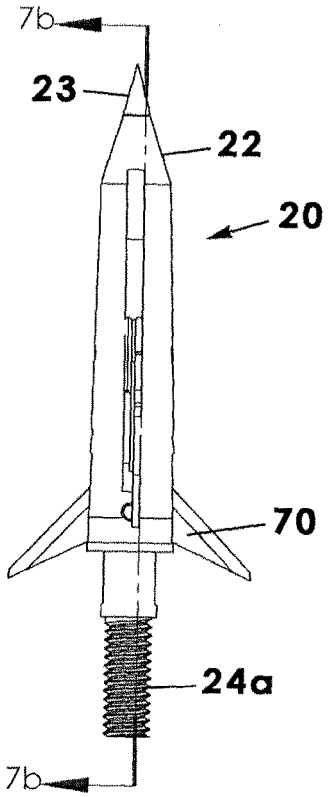
FIG. 7*a* is a side view of the broadhead as in FIG. 1*a;*

The broadhead 10 includes a trigger blade assembly 30 having at least a pair of trigger blades 32. Each trigger blade 32 includes a proximal end 34 rotatably coupled to a shared trigger blade mounting pin 38 situated in the interior area of the body 20. Each trigger blade 32 is rotatably movable between an initially deployed configuration (FIG. 6*b*) and a rotated configuration (FIG. 7*b*). At the deployed configuration, a distal end 36 of a respective trigger blade 32 extends outwardly away from the side wall 26 of the body 20, the trigger blade 32 extending through a respective upper blade slot 28 when at its deployed configuration (FIG. 4*b*). At the rotated configuration, each trigger blade 32 may be rotated about the trigger blade mounting pin 38 until being directed generally toward the rear end 24 (FIG. 7*b*), the movement between the initial deployed configuration and the rotated configuration being described later.

A dynamic blade assembly 50 includes a pair of dynamic blades 52, each dynamic blade 52 having a proximal end 54 rotatably coupled to a shared dynamic blade mounting pin 58. Each dynamic blade 52 is rotatably movable, when actuated, between a retracted configuration entirely situated inside the interior area of the body 20 (FIG. 6*b*) and an extended configuration in which distal ends 56 of respective dynamic blades 52 extend outwardly away from the side wall 26 of the body (FIG. 7*b*). At the extended configuration, distal ends 56 of respective dynamic blades 52 extend through the upper blade slot 28.

Proximal ends 34 of respective trigger blades 32 are in operative communication with proximal ends 54 of respective dynamic blades 52 such that rotation of respective trigger blades 32 causes a corresponding rotation of respective dynamic blades 52 according to their constructions and operations as will be described below. In use, the dynamic blades 52 are only moved to the extended configuration when the trigger blades 32 are moved from the initially deployed configuration (FIG. 6*b*) to the rotated configuration (FIG. 7*b*). And the trigger blades 32 are actuated to move to the rotated configuration when the ring 25 is slidably moved to the actuated configuration (FIG. 7*b*) as described below.

Now the construction and configuration of the respective blades will be described in more detail. Each trigger blade 32 includes a trigger blade cutting edge 40 adjacent to and extending inwardly from an associated trigger blade distal end 36. The trigger blade cutting edge 40 is on a front edge thereof and faces the front end 22 of the body 20 and is configured to cut into the skin and body of an animal upon initial impact. Each trigger blade 32 defines a trigger blade notched area 42 adjacent its associated proximal end 34. Similarly, each dynamic blade 52 includes a dynamic blade cutting edge 60 adjacent to and extending inwardly from an associated dynamic blade distal end 56. The dynamic blade cutting edge 60 is on a front edge thereof and is configured to cut through the body of an animal and make an exit hole through the hide of the animal when the dynamic blades 52 are in the extended configuration.

Figure 6B:
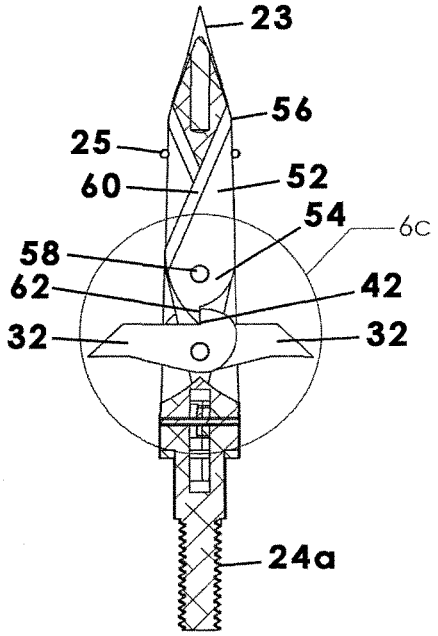
FIG. 6*b* is a sectional taken along line 6*b*-6*b* of FIG. 6*a*, illustrating the dynamic blades in a retracted configuration.
Figure 6A:
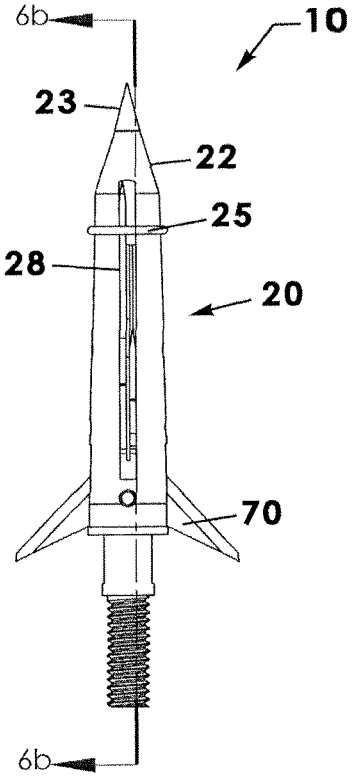
FIG. 6*a* is another side view of the broadhead as in FIG. 1*a;*
Figure 6C:
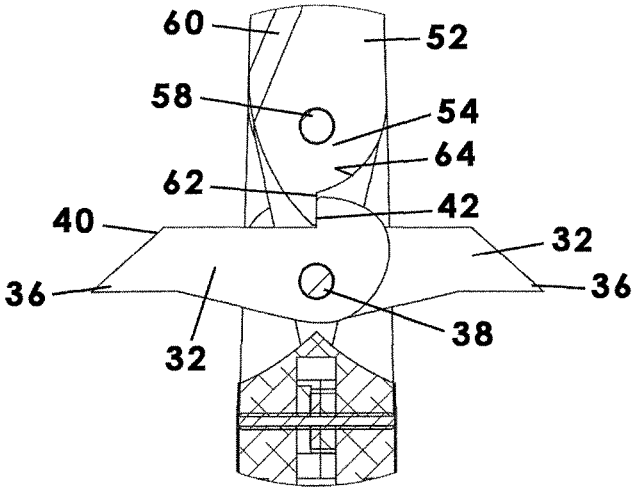
FIG. 6*c* is an isolated view on an enlarged scale taken from FIG. 6*b;*
Figure 7C:
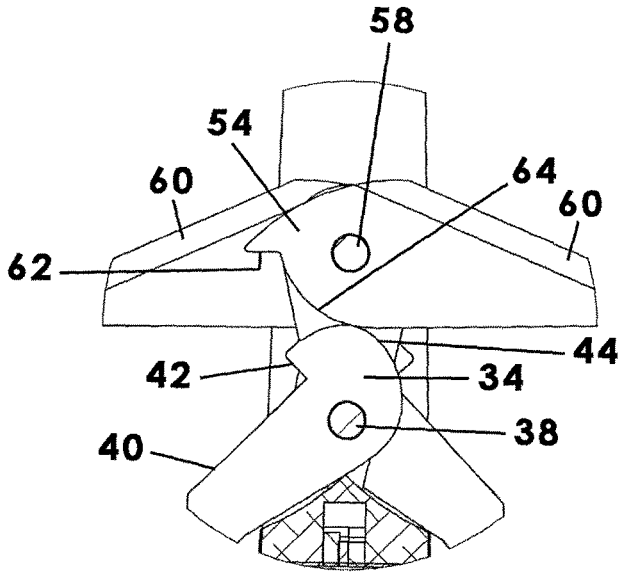
FIG. 7*c* is an isolated view on an enlarged scale taken from FIG. 7*b*.

Further, each dynamic blade 52 defines a dynamic blade notched area 62 proximate a respective dynamic blade proximal end 54 (FIG. 7*c*). Preferably, each respective trigger blade notched area 42 is operatively nested in a respective dynamic blade notched area 62 such that the respective dynamic blade 52 is rotated about an associated dynamic blade mounting pin 58 when a respective trigger blade 32 is rotated about an associated trigger blade mounting pin 38 from the deployed configuration to the rotated configuration as described above. It should also be noted that each dynamic blade 52 is perpendicular to a corresponding trigger blade 32 to which it is operatively nested when considered while the pair of trigger blades are at the initially deployed configuration (FIG. 6*c*).

The ring 25 may be an O-ring constructed of a flexible material such as rubber such that a diameter defined thereby may be extended as the O-ring may be stretched. The ring 25 may be initially positioned about the body 20 proximate the front end 22 and such that it covers an portion of the upper blade slot 28, thus blocking and preventing the dynamic blades 52 from extending out of the interior area (FIG. 6*a*). In other words, the ring 25 initially prevents the dynamic blades 52 from rotating to the extended configuration. Upon impact with the body 20 with an animal, the flesh and organs of the animal pushes the ring 25 from the initial frontward position toward the rear end 24. When the ring 25 impacts the trigger blades 32 that are initially in the deployed configuration described above, trigger blades 32 are actuated to rotate to the rotated configuration. The nested connection between the trigger and dynamic blades causes the dynamic blades to move rotatably to the extended configuration (FIG. 7*b*). The ring 25 moves past the trigger blades to a point proximate the rear end 24 of the body 20 (FIG. 7*b*).

Again referring to the blade assemblies, each trigger blade 32 includes a trigger blade rounded section 44 adjacent the trigger blade notched area 42 and proximate the trigger blade proximal end 34. Similarly, each dynamic blade 52 includes a dynamic blade rounded section 64 adjacent the dynamic blade notched area 62 and proximate the dynamic blade proximal end 54. Respective rounded sections are situated such that a respective trigger blade rounded section 44 bears tightly against a respective dynamic blade rounded section 64 as a respective trigger blade 32 is actuated to rotate from the deployed configuration to the rotated configuration as described above. In fact, the rounded sections are configured such that the friction fit is sufficiently tight so as to stop rotation thereof as shown in FIG. 7*c*. In other words, over-rotation is prevented by the configuration of respective rounded sections.

In another aspect, the broadhead 10 may include a fixed blade assembly 71 having a pair of fixed blades 70 each having a proximal end 74 rotatably coupled to a fixed blade pin 76 situated inside the interior area of the body 20 adjacent the rear end 24 thereof. Each fixed blade 70 includes a cutting edge and a distal end 75 extending outwardly away from the side wall 26 of the body 20. The side wall 26 of the body 20 defines a pair of opposed lower slots 29 through which the fixed blades 70 may extend. Preferably, the fixed blades 70 extend outwardly and toward the rear end 24. However, the fixed blades are capable of rotating on the fixed blade pin 76 about 40 degrees in the direction of the front end 22. Upon removal of the broadhead from an animal, this rotational movement of the fixed blade pin 76 keeps the broadhead from being a barb and allows the blade to work itself out or be removed in the event of a bad shot.

In yet another aspect, the broadhead 10 may include one or more shims positioned in the interior area of the body 20 and configured to give stability to respective blade assemblies. More particularly, a fixed blade shim 80 is sandwiched between the pair of fixed blades 70. The fixed blade shim 80 includes one or more bent tabs 82 extending from an upper edge thereof, the bent tabs 82 bearing against forward edges of respective fixed blades 70 to substantially resist pivotal movement of the fixed blades 70 about the fixed blade mounting pin 76. In use, the fixed blade shim 80 and its bent tabs 82 prevents movement of the fixed blades 70 even while absorbing the impact force of the broadhead 10 piercing an animal or target. However, the strength of the bent tabs 82 may be overcome by a hunter—manually or using a tool—so that the fixed blades 70 may be pivoted forward so as to eliminate a barbed condition that would unnecessarily tear the animal upon broadhead removal.

Figure 2A:
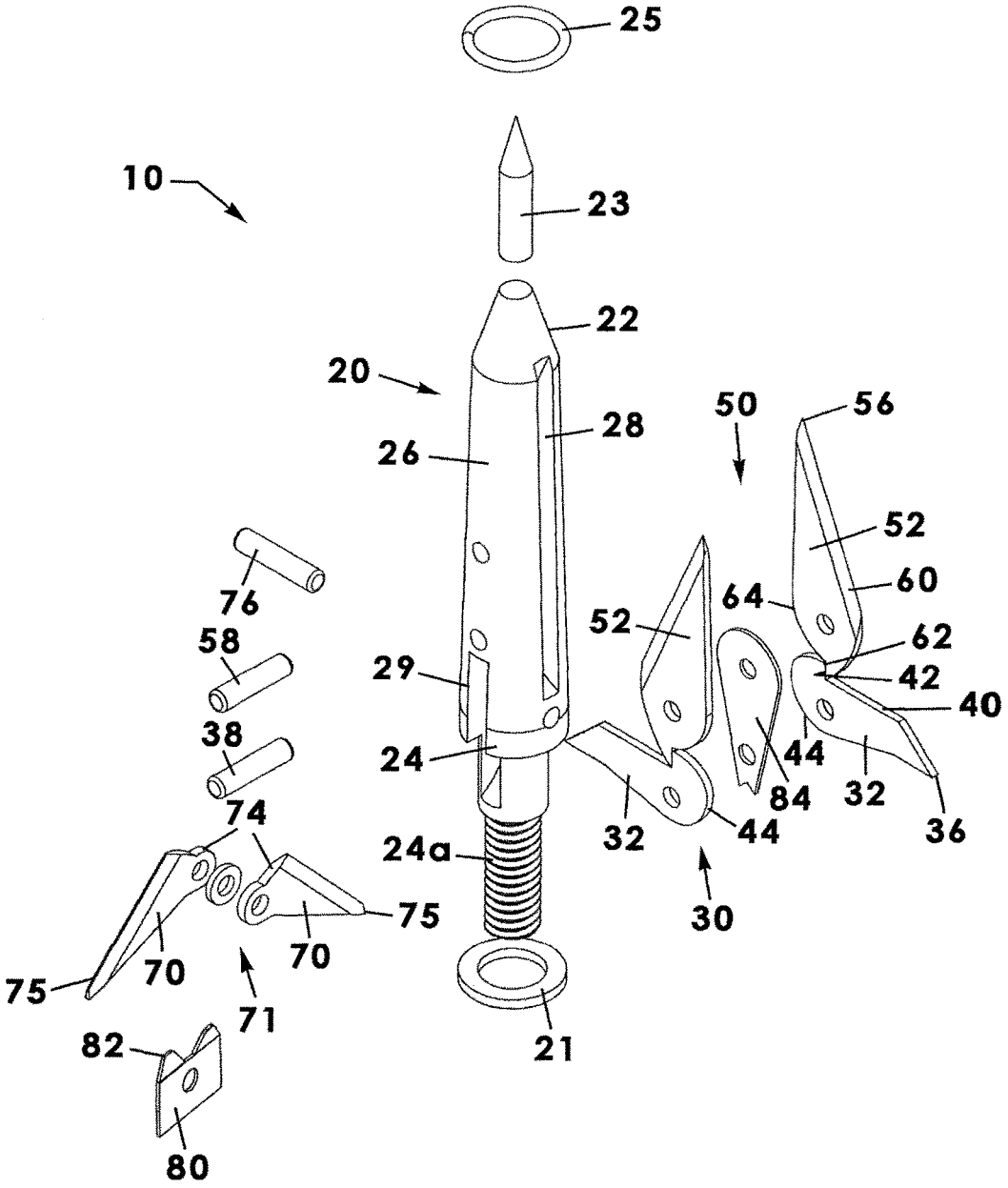
FIG. 2*a* is an exploded view of the broadhead as in FIG. 1*a;*
Figure 3B:
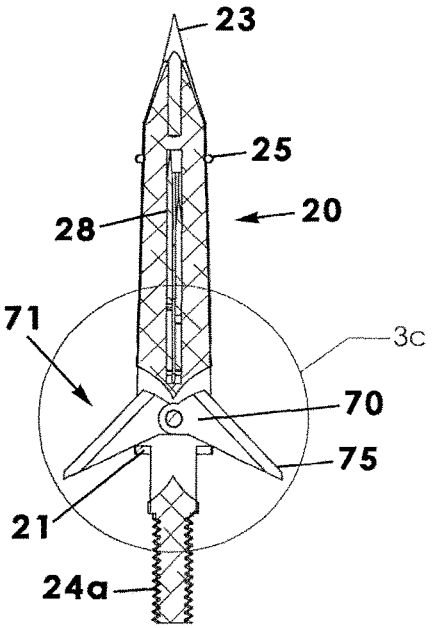
FIG. 3*b* is a sectional view taken along line 3*b*-3*b* of FIG. 3*a* and illustrating the fixed blades at a normally rearwardly extending configuration.
Figure 3A:
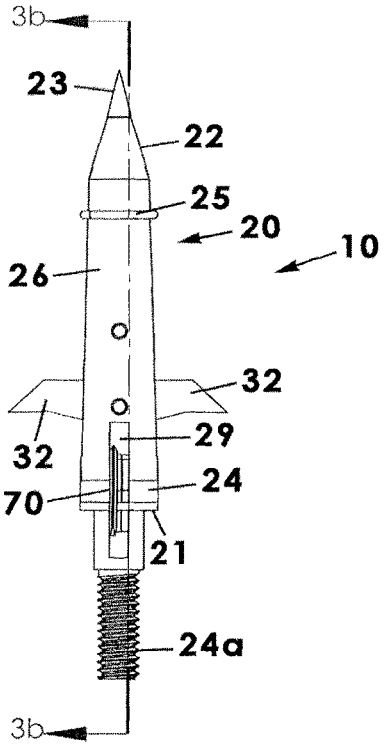
FIG. 3*a* is a side view of the broadhead as in FIG. 1*a;*
Figure 3C:
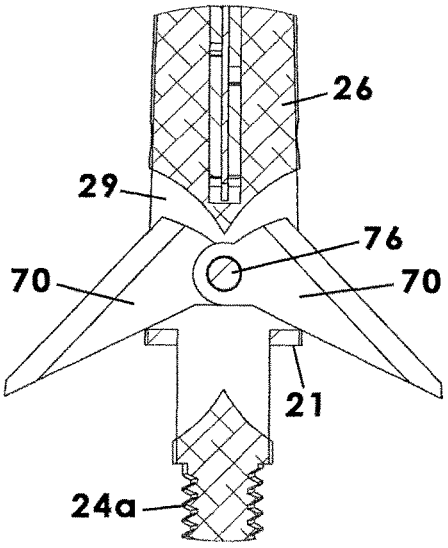
FIG. 3*c* is an isolated view on an enlarged scale taken from FIG. 3*b;*

Similarly, an separation shim 84 is coupled to the trigger blade pin 38 and to the dynamic blade pin 58 and has a planar configuration, the separation shim 84 being sandwiched between respective trigger blades 32 and dynamic blades 52 (FIG. 2*a*). The separation shim 84 keeps respective blades from rotating during the flight of the broadhead 10 as it is launched from a compound or crossbow.

In use, the broadhead 10 according to the present invention may be threadably coupled to the forward end of an arrow (not shown) in a traditional manner. When launched, respective fixed blades 70 and respective trigger blades 32 may be seen extending outwardly from and through the side wall 26 of the body 20. The tip 25 at the front end 22 of the body 20 is first to pierce a targeted animal and the trigger blades 32 enhance the initial entry. The impact urges the trigger blades 30 to rotate rearwardly, this rotation causing the dynamic blades 53 to rotate from the retracted configuration within the interior area of the body 20 to an outwardly extending configuration that enhances the broadhead's ability to cut through the interior or the targeted animal and even to enlarge an exit therefrom. In other words, rotation of the trigger blades 32 as a result of cutting friction causes the dynamic blades 53 to deploy.

It is understood that while certain forms of this invention have been illustrated and described, it is not limited thereto except insofar as such limitations are included in the following claims and allowable functional equivalents thereof.

The invention claimed is:

1. A broadhead with dynamic blades that deploy upon impact with an animal, comprising:

a body having opposed front and rear ends and having a continuous side wall extending between said front and rear ends that has a generally cylindrical configuration that defines an interior area, said side wall defining a plurality of slots in communication with said interior area;

a trigger blade assembly having a pair of trigger blades rotatably mounted on a trigger mounting pin inside said interior area, said pair of trigger blades being rotatable between an initially deployed configuration in which distal ends of respective trigger blades extend outwardly away from said side wall and a rotated configuration;

a dynamic blade assembly having a pair of dynamic blades rotatably mounted on a dynamic blade mounting pin inside said interior area, said pair of dynamic blades being movable between a retracted configuration situated completely within said interior area so long as said pair of trigger blades is in said deployed configuration and an extended configuration in which distal ends of respective dynamic blades extend outwardly away from said side wall when said pair of trigger blades is moved to said rotated configuration;

wherein proximal ends of said pair of trigger blades are operatively coupled to proximal ends of said pair of dynamic blades such that rotation of said pair of trigger blades causes a corresponding rotation of said dynamic blades;

a ring associated with said body that is slidably movable between a flight configuration positioned proximate said front end of said body that prevents said dynamic blades from moving to said deployed configuration and an actuated configuration displaced from said front end that bears against said distal ends of said pair of trigger blades and allows said dynamic blades to move to said deployed configuration.

2. The broadhead as in claim 1, wherein said side wall of said body defines a pair of opposed blade slots extending between said front and rear end and in communication with said interior area, said opposed blade slots being configured to receive respective trigger blades and respective dynamic blades therethrough.

3. The broadhead as in claim 1, wherein said ring is an O-ring having a circular configuration and constructed of a flexible material, said ring defining a diameter that is selectively increased when stretched.

4. The broadhead as in claim 1, further comprising a fixed blade assembly having a pair of fixed blades each having a proximal end coupled to a fixed blade pin inside said interior area adjacent said rear end, each fixed blade having a distal end displaced outwardly and rearwardly away from said side wall of said body.

5. The broadhead as in claim 4, further comprising:

a fixed blade shim having a planar configuration and situated between said pair of fixed blades, said fixed blade shim having a pair of bent tabs configured to bear against respective fixed blades so as to resist pivotal movement thereof; and a separation shim having a planar configuration and situated between respective trigger blades and respective dynamic blades.

6. The broadhead as in claim 1, further comprising a threaded member extending rearwardly from said rear end of said body, said threaded member having a linear configuration configured for reception into a counterbore of an arrow shaft.

7. The broadhead as in claim 1, wherein:

each said trigger blade includes a trigger blade cutting edge adjacent an associated distal end and a trigger blade notched area proximate an associated proximal end;

each said dynamic blade includes a dynamic blade cutting edge adjacent an associated distal end and a dynamic blade notched area proximate an associated proximal end;

said trigger blade notched area is operatively nested in said dynamic blade notched area such that said dynamic blade is rotated about said dynamic blade mounting pin when said trigger blade is rotated on said trigger blade mounting pin from said deployed configuration to said rotated configuration.

8. The broadhead as in claim 7, wherein each said dynamic blade is perpendicular to a corresponding trigger blade to which said dynamic blade is operatively nested when said pair of trigger blades are at said deployed configuration.

9. The broadhead as in claim 7, wherein:

each said trigger blade includes a trigger blade rounded section adjacent said trigger blade notched area;

each said dynamic blade includes a dynamic blade rounded section adjacent said dynamic blade notched area;

each said trigger blade rounded section bears tightly against said dynamic blade rounded section when each said trigger blade is moved to said rotated configuration and, correspondingly, each said dynamic blade is moved to said extended configuration.

10. The broadhead as in claim 1, wherein said front end of said body includes a domed configuration having a sharp tip configured to penetrate an animal's skin upon impact.

11. The broadhead as in claim 1, wherein:

said front end of said body includes a domed configuration having a sharp tip configured to penetrate an animal's skin upon impact;

said rear end of said body includes a threaded member having a cylindrical configuration extending longitudinally and configured for reception into a counterbore of an arrow shaft.

12. A broadhead with dynamic blades that deploy upon impact with an animal, comprising:

a body having opposed front and rear ends and having a continuous side wall extending between said front and rear ends that has a generally cylindrical configuration that defines an interior area, said side wall defining a plurality of slots in communication with said interior area;

a trigger blade assembly having a pair of trigger blades rotatably mounted on a trigger mounting pin inside said interior area, said pair of trigger blades being rotatable between an initially deployed configuration in which distal ends of respective trigger blades extend outwardly away from said side wall and a rotated configuration;

a dynamic blade assembly having a pair of dynamic blades rotatably mounted on a dynamic blade mounting pin inside said interior area, said pair of dynamic blades being movable between a retracted configuration situated completely within said interior area so long as said pair of trigger blades is in said deployed configuration and an extended configuration in which distal ends of respective dynamic blades extend outwardly away from said side wall when said pair of trigger blades is moved to said rotated configuration;

wherein proximal ends of said pair of trigger blades are operatively coupled to proximal ends of said pair of dynamic blades such that rotation of said pair of trigger blades causes a corresponding rotation of said dynamic blades;

a ring associated with said body that is slidably movable between a flight configuration positioned proximate said front end of said body that prevents said dynamic blades from moving to said deployed configuration and an actuated configuration displaced from said front end that bears against said distal ends of said pair of trigger blades and allows said dynamic blades to move to said deployed configuration;

wherein said side wall of said body defines a pair of opposed upper blade slots extending between said front and rear end and in communication with said interior area, said opposed upper blade slots being configured to receive respective trigger blades and respective dynamic blades therethrough.

13. The broadhead as in claim 12, further comprising:

a fixed blade assembly having a pair of fixed blades each having a proximal end coupled to a fixed blade pin inside said interior area adjacent said rear end, each fixed blade having a distal end displaced outwardly and rearwardly away from said side wall of said body;

wherein said side wall of said body defines a pair of opposed lower blade slots extending between said front and rear end adjacent said rear end and in communication with said interior area, said opposed lower blade slots being configured to receive respective fixed blades therethrough.

14. The broadhead as in claim 12, wherein said ring is an O-ring having a circular configuration and constructed of a flexible material, said ring defining a diameter that is selectively increased when stretched.

15. The broadhead as in claim 12, wherein:

each said trigger blade includes a trigger blade cutting edge adjacent an associated distal end and a trigger blade notched area proximate an associated proximal end;

each said dynamic blade includes a dynamic blade cutting edge adjacent an associated distal end and a dynamic blade notched area proximate an associated proximal end;

a respective trigger blade notched area is operatively nested in a respective dynamic blade notched area such that a respective dynamic blade is rotated about an associated dynamic blade mounting pin when a respective trigger blade is rotated on an associated trigger blade mounting pin from said deployed configuration to said rotated configuration.

16. The broadhead as in claim 15, wherein each said dynamic blade is perpendicular to a corresponding trigger blade to which said dynamic blade is operatively nested when said pair of trigger blades are at said deployed configuration.

17. The broadhead as in claim 15, wherein:

each said trigger blade includes a trigger blade rounded section adjacent said trigger blade notched area;

each said dynamic blade includes a dynamic blade rounded section adjacent said dynamic blade notched area;

each said trigger blade rounded section bears tightly against said dynamic blade rounded section when each said trigger blade is moved to said rotated configuration and, correspondingly, each said dynamic blade is moved to said extended configuration.

18. The broadhead as in claim 13, further comprising:

a fixed blade shim having a planar configuration and situated between said pair of fixed blades, said fixed blade shim having a pair of bent tabs configured to bear against respective fixed blades so as to resist pivotal movement thereof; and a separation shim having a planar configuration and situated between respective trigger blades and respective dynamic blades.

* * * * *